US005230323A

United States Patent [19]

Saunders et al.

[11] Patent Number: 5,230,323

[45] Date of Patent: Jul. 27, 1993

[54] SLINGSHOT CONSTRUCTION

[76] Inventors: Charles A. Saunders, Box 476 - Industrial Site, Columbus, Nebr. 68601-0476; Eugene E. Saunders, 2501 - 18th St., Columbus, Nebr. 68601

[21] Appl. No.: 892,338

[22] Filed: Jun. 2, 1992

[51] Int. Cl.[5] ..... F41B 3/02

[52] U.S. Cl. ..... 124/20.1; 124/17

[58] Field of Search ..... 124/17, 20.1

[56] References Cited

U.S. PATENT DOCUMENTS

| | | | |
|---|---|---|---|
| 2,715,895 | 8/1955 | Loveless . | |
| 2,995,129 | 8/1961 | Malott | 124/20.1 |
| 3,018,770 | 1/1962 | Saunders | 124/20.1 |
| 3,511,221 | 5/1970 | Saunders | 124/20.1 |
| 3,524,439 | 8/1970 | Dantzler . | |
| 3,749,075 | 7/1973 | Saunders | 124/20.1 |
| 3,812,834 | 5/1974 | Saunders | 124/20.1 |
| 4,373,503 | 2/1983 | Saunders | 124/20.1 |
| 4,569,324 | 2/1986 | Garcia | 124/20.1 |
| 4,722,316 | 2/1988 | Stinnett et al. | 124/20.1 |
| 4,873,964 | 10/1989 | Bonoan | 124/20.1 |

OTHER PUBLICATIONS

Copy-one sheet from Kessler Sales Corporation showing the product title: Hand Held Slingshot-File #40,137-patented Feb. 11, 1986.

Copy-of front page of catalog (1983) of Saunders Archery Co. with attached copy of p. 12.

Copy of front page of catalog (1984) of Saunders Archery Co. with attached copy of p. 12.

Copy-of front page of catalog (1985) of Saunders Archery Co. with attached copy of p. 16.

Copy-of front of catalog (1986) of Saunders Archery Co. with attached copy of p. 22.

Copy-of front of catalog (1987) of Saunders Archery Co. with attached copy of p. 21.

Copy-of front of catalog (1988) of Saunders Archery Co. with attached copy of p. 24.

Copy-of front of catalog (1989) of Saunders Archery Co. with attached copy of p. 24.

Copy-of front of catalog (1990) of Saunders Archery Co. with attached copy of p. 21.

*Primary Examiner*—Randolph A. Reese

*Assistant Examiner*—John Ricci

*Attorney, Agent, or Firm*—Henderson & Sturm

[57] ABSTRACT

A slingshot construction (10) including a handle member (20), a pair of upwardly projecting arm elements (32) attached to the handle member (20), a pair of elastic bands (13) attached on one end to the arm elements (32) and attached on the other end to a pouch (14); wherein, the improvement comprises using multiple lengths of rubber tubing (40) as the elastic bands (13) on each side of the slingshot.

4 Claims, 2 Drawing Sheets

SLINGSHOT CONSTRUCTION

TECHNICAL FIELD

The present invention relates to the field of slingshot constructions in general, and in particular to a four banded slingshot construction which exhibits superior wear and performance characteristics over the conventional double banded construction.

BACKGROUND ART

As can be seen by reference to the following U.S. Pat. Nos. 3,511,221; 3,749,075; 3,812,834; and 4,373,503; the prior art is replete with myriad and diverse slingshot constructions.

While all of the aforementioned prior art constructions are more than adequate for the basic purpose and function for which they have been specifically designed, these patented devices are uniformly deficient with regard to the following areas: limited useful life of the elastic bands due to hysteresis losses; the necessity of employing thick walled tubing in the elastic bands, and, obstruction of the sight picture by the central location of the elastic bands relative to the sling pouch.

As a consequence of the foregoing situation, there has existed a longstanding need among both casual and serious users of slingshots, for a new type of slingshot construction that will have superior wear and performance characteristics, as well as presenting a less obscured view of the target; and, the provision of such a construction is a stated objective of the present invention.

DISCLOSURE OF THE INVENTION

Briefly stated, the improved slingshot construction that forms the basis of the present invention comprises a multi-banded slingshot construction which includes: a handle; a multi-pronged hook assembly; a pair of elastic bands; a pouch; an arm brace; and, a retaining clip.

While all of the aforementioned components cooperate with one another in a generally conventional manner, there are some unique structural features incorporated into this particular slingshot construction which deviate substantially from the accepted conventional slingshot constructions; and, which produce far superior results.

As will be explained in greater detail further on in the specification, while this invention has initially been described as a multi-banded slingshot construction, only two elastic bands per side are employed in the preferred embodiment shown; however, each of these bands has an elongated length; wherein both ends of each elastic band form a closed loop in conjunction with the opposite sides of the multi-pronged hook assembly.

In addition the intermediate portions of these elongated bands are threadably connected to the pouch to form a quick, efficient, lightweight, reliable, and cost effective operative engagement between these two structural components.

Furthermore, since thinner walled tubing can be employed in the elongated elastic bands with no loss in strength; and, each of the elastic bands has a two point attachment to the multi-armed hook assembly; therefor less wear load and hysteresis loss occurs when the pouch passes between the multi-pronged hook assembly and a reverse bend is placed on the elastic bands. Also the gap opening between each of the loops formed by each band substantially improves the sight picture of the shooter since the shooter can sight either through the gap, or in the alternative has only half of the sight picture obscured that would exist with the thicker tubing employed in the conventional constructions.

BRIEF DESCRIPTION OF THE DRAWINGS

These and other attributes of the invention will become more clear upon a through study of the following description of the best mode for carrying out the invention, particularly when reviewed in conjunction with the drawings wherein.

BEST MODE FOR CARRYING OUT THE INVENTION

Figure 1:
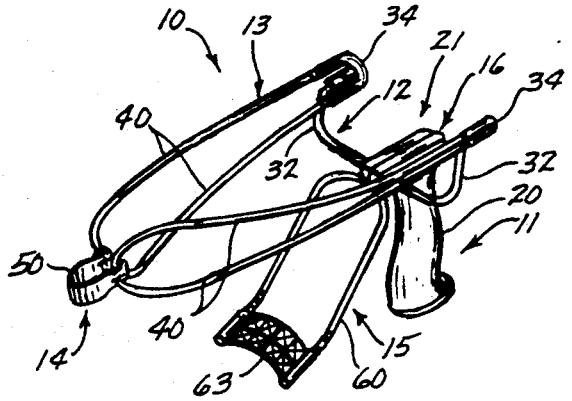
FIG. 1 is a perspective view of the slingshot construction that forms the oasis or the present invention.

As can be seen by reference to the drawings, and in particular to FIG. 1, the slingshot construction that forms the basis of the present invention is designated generally by the reference numeral (10). The slingshot construction (10) comprises in general: a handle (11) a multi-pronged hook assembly (12); a pair of elastic bands (13); a pouch (14); an arm brace (15); and, a retaining clip (16). These structural components will now be described in seriatim fashion.

Figure 8:
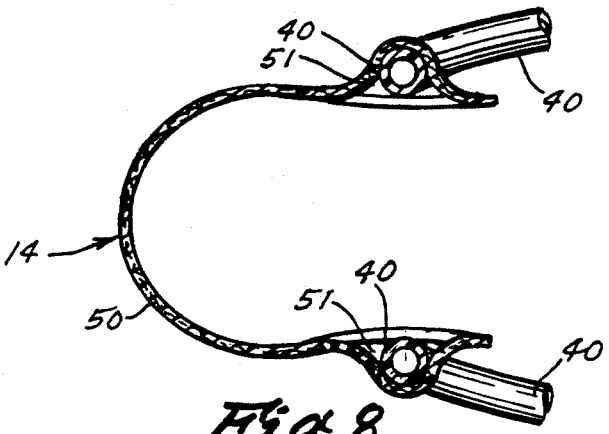
FIG. 8 is a cross-sectional view taken through line 8—8 of FIG. 3.
Figure 9:
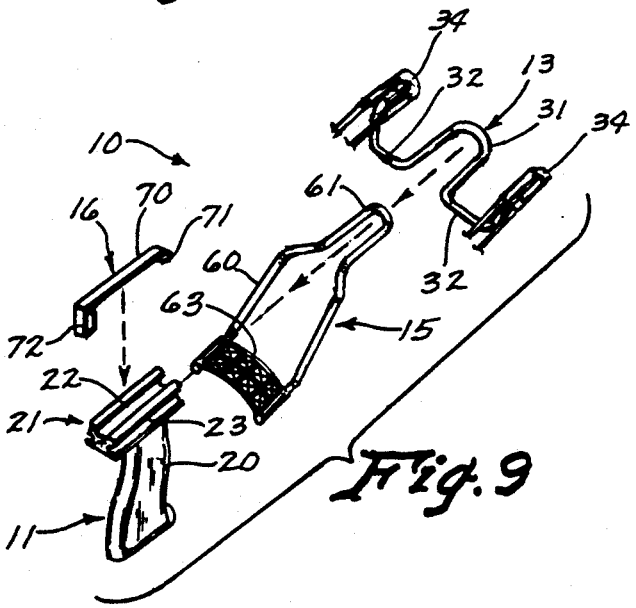
FIG. 9 is an exploded perspective view of the operative cooperation between some of the more conventional components of the invention.

As can best be seen by reference to FIGS. 1 through 9 the handle (11) comprises a pistol grip handle member (20) fabricated from wood or plastic and having a generally flat top (21). In addition as shown in FIG. 9 the handle member (20) is further provided with an elongated recess (22) which is dimensioned to receive a portion of the clip (16); and, a peripheral recess (23) which is dimensioned to receive portions of the hook assembly (12) and the arm brace (15) as will be explained further on in the specification.

Turning now to FIGS. 2, 3 and 6 through 9 it can be seen that the multi-pronged hook assembly (12) comprises a symmetrically configured metal rod member (30) having a generally U-shaped, horizontally disposed yoke portion (31) which is dimensioned to be received in the peripheral recess (23) of the handle member (20). In addition the metal rod member (30) is further provided with a pair of outwardly and upwardly projecting arm elements (32) which terminate in rearwardly facing, angled prong members designated generally as (34).

Figure 5:
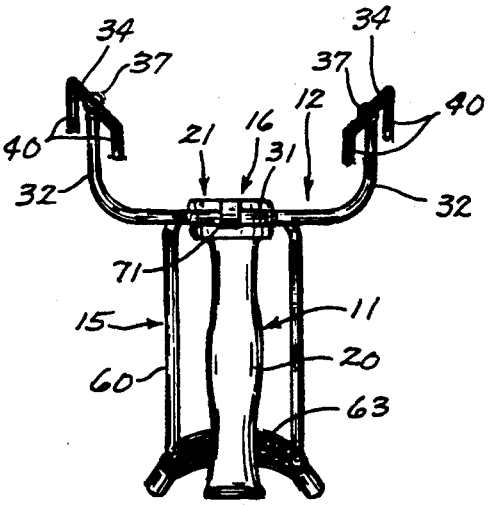
FIG. 5 is a front elevation view of the slingshot construction.
Figure 6:
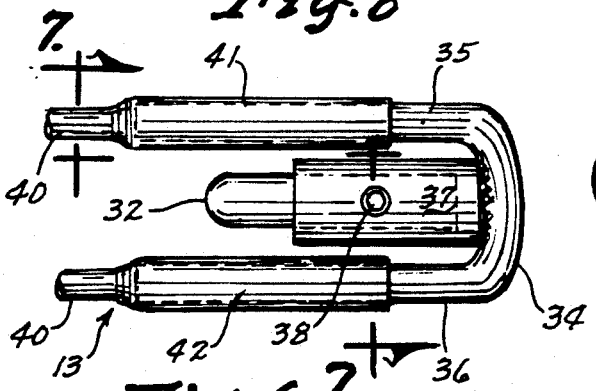
FIG. 6 is an enlarged detail view of the operative attachment of one of the elastic bands with one of the multi-pronged hook assembly.
Figure 7:
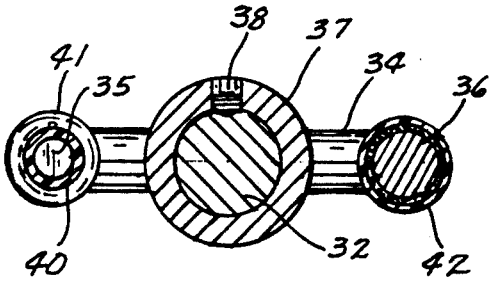
FIG. 7 is a cross-sectional view taken through line 7—7 of FIG. 6.

As can best be seen by reference to FIGS. 5 through 7, each of the prong members (34) comprise a pair of angularly offset hook elements (35) (36) which are secured to the ends of the respective arms (32) via a cylindrical mounting bracket (37) provided with a locking nut (38).

As shown in FIGS. 4 through 7, each of the prong members (34) comprise a generally U-shaped metal rod, which is rigidly fastened to, and surrounds the opposite sides of the cylindrical mounting element. In addition as can be seen particularly be reference to FIGS. 4 and 5 the cylindrical mounting element (37) is secured to each of the prong members (34); such that one hook element (35) is disposed at an upwardly and outwardly angled orientation relative to one prong member (34); and, the other hook element (36) is disposed at a downwardly and inwardly angular orientation relative to the other prong member (34).

Figure 2:
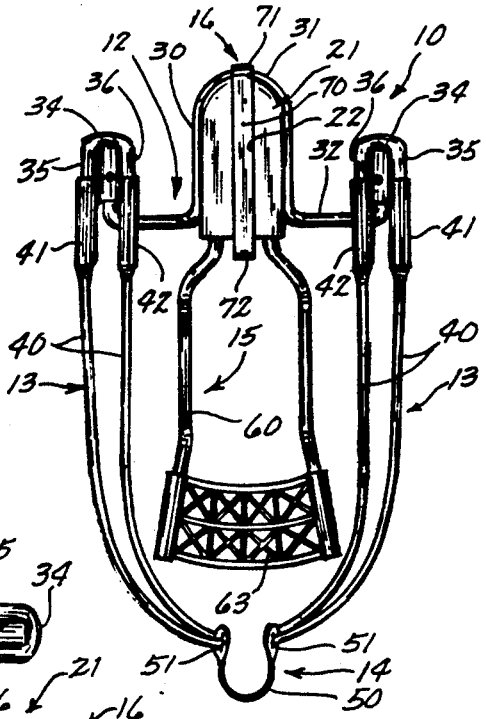
FIG. 2 is a top plan view of the slingshot construction.
Figure 3:
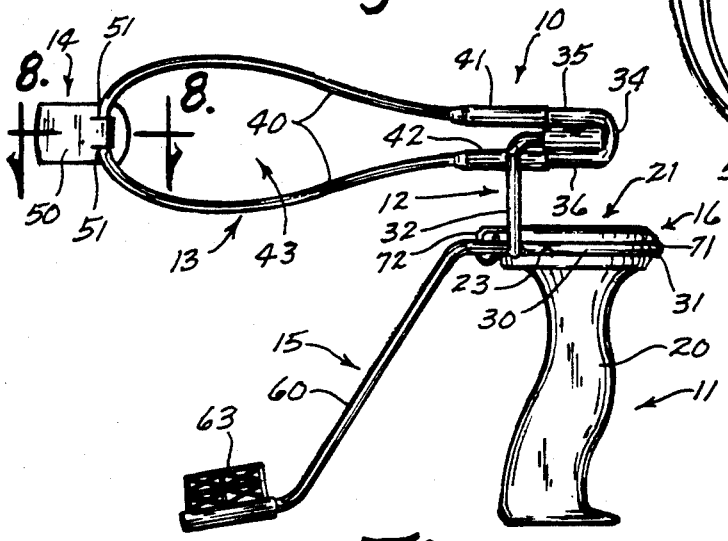
FIG. 3 is a side elevation view of the slingshot construction.

Turning now to FIGS. 2, 3, and 6, it can be seen that the elastic bands (13) each comprise an elongated length of thin walled rubber tubing (40) wherein the open ends (41) (42) are adapted for interchangeable frictional attachment to the hook elements (35) (36) on either one of the hook members (34) in a well recognized manner.

As can also be appreciated by reference to FIGS. 2, 3 and 6, each of the elastic bands (13) employed in this invention has an actual length that is at least twice the distance of its effective length, since the rubber tubing is formed into a loop to establish the operative engagement between each elastic band (13) and one of the prong members (34).

Figure 4:
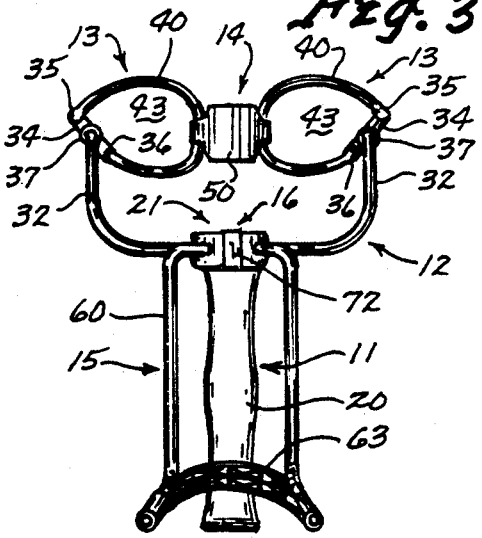
FIG. 4 is a rear elevation view of the slingshot construction.

As can be seen by reference to FIGS. 3, 4 and 8, the pouch (14) comprises a flexible pouch member (50) having a pair of aligned generally horizontal slits (51) formed proximate each of the ends of the pouch member (50); wherein, the slits (51) on each end of the pouch member (50) are dimensioned to slidably receive the intermediate portion of the elastic bands (13) in a threaded fashion.

It should also be appreciated at this juncture that the threaded engagement of the tubing (40) through the slits (51) in the pouch member (50) significantly simplifies the attachment of the pouch (14) to the elastic bands (13) when compared to the conventional techniques.

Turning now to FIG. 9 it can be seen that the arm brace (15) comprises a generally U-shaped collar (60) having an intermediate yoke portion (61) which is dimensioned to be received in the peripheral recess (23) in the handle member (20); wherein, the outboard ends of the collar (60) is provided with an arm strap (63) which extends over the users forearm when the handle (20) is gripped in the normal manner. The multi-band concept disclosed herein can, of course, be used on any sling shot and not just on the one disclosed in the drawings.

Still referring to FIG. 9 it can be seen that the clip (16) comprises a clip member (70) having spring loaded capture arms (71) (72) disposed on its opposite ends; wherein, the clip member (70) is dimensioned to be received in the recess (21) in the top of the handle (20) to captively retain the multi-pronged hook assembly (13) and the arm brace (15) relative to the handle member (20).

In the broadest form of the invention, each of the elastic bands (40) can be either one long band folded in half to form two strands as shown in the drawings or the elastic bands can just be multiple bands of the same length, with one end of each shorter band connected to one of the spaced apart arms (32) and the other end of each strand connected to a pouch similar to pouch (50).

Obviously many modifications and variations are possible in view of the above teachings. For example, more than two bands (40) can be used to provide more efficiency with less weight and less material than using a thicker one piece tubing to obtain the same velocity during operation. It is therefore to be understood that, within the scope of the appended claims, the invention may be practiced otherwise than specifically described.

I claim:

1. A slingshot construction including a handle member and a hook assembly attached to the handle member and having a pair of upwardly projecting arm elements wherein the improvement comprises:

a pouch including a flexible pouch member;

a pair of elastic bands operatively connected on one end to said arm elements and operatively connected on the other end to said pouch member; wherein, each of said pair of elastic bands comprises an elongated length of rubber tubing; wherein, the actual length of the unstretched rubber tubing is at least twice the effective length of the unstretched elastic band;

wherein, the upwardly projecting arms are further provided with rearwardly facing prong members; wherein each prong member comprises a pair of hook elements that are dimensioned to be received within the opposite ends of one of the lengths of rubber tubing; and wherein, the hook elements on the prong members are angularly offset from one another.

2. The construction as in claim 1; wherein, the pouch member is provided with aligned pairs of slits proximate both ends of the flexible pouch member; wherein, each pair of slits is dimensioned to slidably receive the intermediate portions of the rubber tubing.

3. The construction as in claim 1; wherein, the prong members further comprise a generally cylindrical mounting element that is dimensioned to receive the upper ends of the arm elements.

4. The construction as in claim 3; wherein, the mounting element is further provided with locking means for orienting the hook elements of each prong member at a desired angle relative to each arm element.

* * * * *